United States Patent [19]

Ploog et al.

[11] Patent Number: 4,786,439

[45] Date of Patent: Nov. 22, 1988

[54] TEXTILE TREATMENT COMPOSITION

[75] Inventors: Uwe Ploog, Haan; Günter Uphues, Monheim; Peter Waltenberger, Hollig; Rudolf Veitenhansl, Haan, all of Fed. Rep. of Germany

[73] Assignee: Henkel Kommanditgesellschaft auf Aktien, Duesseldorf, Fed. Rep. of Germany

[21] Appl. No.: 136,469

[22] Filed: Dec. 22, 1987

Related U.S. Application Data

[63] Continuation of Ser. No. 895,606, Aug. 11, 1986, abandoned.

[30] Foreign Application Priority Data

Aug. 24, 1985 [DE] Fed. Rep. of Germany ..... 3530302

[51] Int. Cl.[4] ..... C11D 3/30

[52] U.S. Cl. ..... 252/544; 252/8.8; 252/89.1; 252/174.17; 252/174.23; 252/DIG. 2; 8/137

[58] Field of Search ..... 252/8.8, 544, 174.17, 252/174.23, DIG. 2, 89.1; 8/137; 260/404.5 R

[56] References Cited

U.S. PATENT DOCUMENTS

| | | | |
|---|---|---|---|
| 2,340,881 | 2/1944 | Kelley et al. | 252/8.8 |
| 3,454,494 | 7/1969 | Clark et al. | 252/8.8 |
| 3,689,424 | 9/1972 | Berg et al. | 252/110 |
| 3,775,316 | 11/1973 | Berg et al. | 252/8.8 |
| 4,169,817 | 10/1979 | Weber | 252/545 |
| 4,268,402 | 5/1981 | Kurze et al. | 8/137 |
| 4,576,757 | 3/1986 | Guth et al. | 260/404.5 |

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

A textile treatment composition comprising a mixture of (A) a dispersion accelerator selected from aldoses and ketoses; polyhydroxyl compounds obtained therefrom by hydrogenation; natural and synthetic hydrophilic polymers; and mixtures thereof; and (B) a fatty acid condensation product obtained by reacting aliphatic $C_8$–$C_{22}$ monocarboxylic acids or amide-forming derivatives thereof with polyamines and subsequent neutralization of unreacted amino groups; a process for producing such composition; and methods for its use. Preferably, the polyamines correspond to the formula $$H_2N\left[(CH_2)_n-\underset{\underset{R}{|}}{N}\right]_m-R^1$$

wherein:

R is hydrogen, methyl, ethyl, or hydroxyethyl, $R^1$ is hydrogen, methyl, ethyl, hydroxyethyl, or $-(CH_2)_n-NHR$, n is 2 to 4, and m is 1 to 4.

26 Claims, No Drawings

TEXTILE TREATMENT COMPOSITION

This application is a continuation of application Ser. No. 895,606, filed Aug. 11, 1986, now abandoned.

BACKGROUND OF THE INVENTION

1. Field of the Invention

The present invention relates to compositions for treating textiles. The invention specifically relates to a textile treatment composition comprising a readily water dispersible mixture of a condensatin product of a carboxylic acid or carboxylic acid derivative and a polyamine and specific dispersion accelerators. The invention further relates to a process for preparing such compositions and to their use of treating textiles.

2. Description of Related Art

Numerous compound or mixtures of substances have been proposed for treating textile fibers, yarns or fabrics in order to impart particularly valuable properties to the textiles. Thus, compositions are available for improving or enhancing the processing properties of textiles, their wearing properties and also their care.

U.S. Pat. No. 2,340,881, for example, describes a condensation product of a hydroxyalkylpolyamine and a fatty acid glyceride useful for improving the smoothness and softness of textiles. As described, these condensation products are used as aqueous dispersions. U.S. Pat. No. 3,454,494 relates to fatty acid condensation products containing a polyoxyalkylene dispersant. U.S. Pat. No. 3,689,424 describes detergents containing fatty acid condensation products which, from their production, contain fatty acid partial glyceride dispersants. In U.S. Pat. No. 3,775,316, these fatty acid condensation products also are described as fabric softeners for use in liquid fabric conditioners.

Aqueous dispersions of these and similar textile treatment compositions may be prepared by heating the water and generally applying an intense shear force or by dispersing a melt of the condensation product in water. Generally, in view of the necessary effort, the manufacturer prepares the aqueous dispersions and then ships such dispersions to the consumer. Thus, the manufacturer bears the expense and inconvenience of transporting considerable quantities of water.

A textile treatment composition based on fatty acid condensation products having an aqueous dispersibility which allows the consumer to prepare the dispersion directly would be a significant advance in the art.

DESCRIPTION OF THE INVENTION

It has been found that adding (A) at least one dispersion accelerator selected from the group comprising: aldose and ketose type monosaccharides; pokyhydroxy compounds derived from such monosaccharides by hydrogenation; and natural and synthetic hydrophilic polymers; and mixtures thereof; to (B) at least one fatty acid condensation product prepared by reacting an aliphatic monocarboxylic acid having from 8 to 22 carbon atoms or an amide-forming derivative thereof with a polyamine, followed by neutralizing unreacted amino groups of the condensation reaction with a lower carboxylic acid, produces a textile treatment composition (A+B) which may be dispersed in a short time, even in cold water.

In the context of the present invention, a textile treatment composition is understood to include products which can be used in preparations for refining fibers and yarns, in detergents and in preparations for post treatment of laundered fabrics.

Fatty acid condensation products (B) used in preparing the textile treatment compositions of the present invention are produced by reacting an aliphatic monocarboxylic acid including natural or synthetic fatty acids and fatty acid mixtures, or an amide-forming derivative thereof with a polyamine. Suitable aliphatic monocarboxylic acids are those having from 8 to 22 carbon atoms and include lauric acid, myristic acid, palmitic acid, and stearic acid, and mixtures of aliphatic monocarboxylic acids such as coconut oil fatty acid, tallow fatty acid or rape oil fatty acid. The amide-forming derivatives of these aliphatic monocarboxylic acids are understood to include lower alkanol fatty acid esters, such as, for example methyl or ethyl fatty acid esters, fatty acid glycerides and fatty acid halides such as chlorides and bromides.

Suitable polyamines for reacting with the aliphatic monocarboxylic acids or amide-forming derivatives thereof correspond to the following formula $$H_2N\text{-}[(CH_2)_n-\underset{\underset{R}{|}}{N}]_m-R'$$

wherein

R is hydrogen, methyl, ethyl, or hydroxyethyl,

R' is hydrogen, methyl, ethyl, hydroxyethyl or $-(CH_2)_n-NHR$ group, n is 2 to 4, and m is 1 to 4.

Suitable polyamines include, for example, diethylene triamine, triethylene tetramine, tetraethylene pentamine, dimethylaminopropylamine, propylene diamine, di(trimethylene)triamine and, in particular, aminoethyl ethanolamine. Preferably, the polyamine has at least two functional groups and most desirably contains both amino and hydroxy groups.

To prepare the fatty acid condensation product, the fatty acid or the fatty acid derivative and the polyamine, for example, are used in a molar ratio of from 0.5:1 to 3:1 (carboxylic acid to polyamine), generally 1:1 to 3:1. While the amount of fatty acid or fatty acid derivative may vary depending upon the material used, generally, about one mol of fatty acid is used for each amino group and hydroxy group of the polyamine. Normally, there is a molar excess of free amino and hydroxyl groups on the polyamine relative to free carboxyl groups. In other words, preferably no more fatty acid is present in the reaction mixture than can be bound by an amine group as an amide and/or by a hydroxy group as an ester.

The reaction components are heated together, with continuous mixing, until virtually all the fatty acid or fatty acid derivative has reacted. Reaction conditions are not critical; generally a temperature between about 150° and 200° C. can be used. For convenience, the reaction is conducted at atmospheric pressure, thus the reaction temperature should not exceed the reactants' boiling points. Under these conditions, the reaction normally will be sufficiently complete in between about 2 to 4 hours. Working in an inert gas atmosphere and/or in the presence of a reducing agent during the condensation reaction leads to particularly light-colored products. Hypophosphorous acid has proved to be a particularly effective reducing agent. Preferably, the degree of reaction, i.e., the percentage of reacted fatty acid, is at least about 95% and most preferably at least about 99%.

Any free or unreacted amino groups of the aliphatic monocarboxylic acid or amide-forming monocarboxylic acid derivative and polyamine adduct then are neutralized with a low molecular weight organic carboxylic acid or hydroxycarboxylic acid, for example, by mixing the fatty acid condensation product in molten form with the necessary (calculated) amount of acid for "salt" formation or by forming the amine "salt" directly by dissolving or dispensing the condensation product in an organic acid or a solution of an organic acid. Free amino groups can be neutralized, for example, either before or after mixing the condensation product with the specific dispersion accelerators of the present invention. Lower carboxylic acids suitable for neutralizing unreacted aminio groups include, in particular, low molecular weight organic, optionally hydroxyl-substituted mono- or poly-carboxylic acids, such as for example glycolic acid, citric acid, lactic acid or acetic acid. THe lower carboxylic acid is selected for compatibility with the treatment medium. The acid used for neutralization (salt formation) is employed in a stoichiometric quantity (relative to free amino groups) or in a stoichiometric excess of up to about 30%.

In order to provide a composition which can be dispersed rapidly in water, at least one dispersion accelerator (A) is added to the fatty acid condensation product. The dispersion accelerator is selected from the group comprising: aldose and ketose type monosaccharides; polyhydroxy compounds obtained by hydrogenating such monosaccharides; and natural and synthetic hydrophilic polymers and mixtures thereof.

The monosaccharides of the aldose and ketose type and their hydrogenation products which are suitable as dispersion accelerators in the present invention contain 4, 5 or in particular 6 carbon atoms in the molecule. Hydrogenation products of the monosaccharides are obtained using well-known techniques. Examples of such materials include fructose, sorbose and in particular glucose, sorbitol and mannitol. These latter materials typically are inexpensive and generally have been found to be highly effective.

Both natural and synthetic hydrophilic polymers also can be used as the dispersion accelerator either alone or in admixture with the monosaccarides and their hydrogenation products. A preferred natural hydrophilic polymer suitable as a dispersion accelerator is gelatin. Other suitable natural hydrophilic polymers include natural gums such as, for example, guar, dextrin, xanthan gum, gum tragacanth and gum arabic, as well as agar agar, carrageen and casein. Particularly suitable synthetic hydrophilic polymers useful as the dispersion accelerator are homopolymers or copolymers based on polyvinyl alcohol, polyacrylic acid and/or polyvinyl pyrrolidone. A common feature or characteristic of all suitable polymers in their ready solubility, dispersibility or swellability in water. Mixtures of gelatin and a monosaccharide or a hydrogenation product of a monosaccharide are particularly suitable.

The dispersion accelerator (A) is added to the fatty acid polyamine condensation product (B) in an amount sufficient to make the composition rapidly dispersible even in cold water. In order to obtain rapid dispersibility, the dispersion accelerator is added in a dispersion-accelerative-effective amount, preferably an amount within the range of from about 0.5 to 10% by weight, most preferably about 2 to 10% by weight, based on the combined weight of dispersion accelerator and fatty acid condensation product. The dispersion accelerators are particularly effective when they are present in intimate admixture with the fatty acid condensation product and any other optional additives of the textile treatment composition. Any mixing technique or procedure suitable for producing an intimate mixture of the various components can be used to prepare the composition, although it has proved particularly effective to mix the fatty acid condensation product in molten form with the dispersion accelerator. The mixture thus obtained then is converted for example using known cooling techniques into solid particle form. For example, the molten mixtue can be solidified as flakes by using known cooling cylinders, as granulates by using known extrusion presses and as powder by spraying.

Textile treatment compositions containing monosaccharides and/or hydrogenation products thereof, particularly in quantities of from about 5 to about 10% by weight, as dispersion accelerators have particularly favorable properties. Equally as useful are textile treatment compositions containing from about 5 to about 10% by weight of gelatin and compositions containing 5 to 10% by weight of a mixture of monosaccharides and/or hydrogenation products thereof with gelatin as dispersion accelerators.

As noted above, compositions of this invention can be dispersed in a short time even in cold water. Generally aqueous dispersions containing from about 0.1 to 2% by weight of the compositon can be prepared rapidly. Typically, the composition needs to be mixed with water for a time of less than about 30 minutes and preferably only from about 10 to 20 minutes in order to form such dispersions containing 0.1 to 2% by weight of the composition. Therefore, as used herein the phrase rapidly dispersible and the like is used to describe compositons which form 0.1 to 2% by weight aqueous dispersions in less than about 30 minutes and preferbly from about 10 to 20 minutes.

In many cases, the presence of other secondary dispersion aids, for example fatty alcohol ethoxylates or oxoalcohol alkoxylates having from 10 to 20 carbon atoms in the alcohol moiety and from 2 to 50 mols of alkylene oxide particularly ethylene oxide and/or propylene oxide, per mol of alcohol in the alkoxylated adduct are useful. Preferred secondary dispersion aids are an adduct of tallow alcohol and 50 mols of ethylene oxide, an adduct of cocoa-alcohol and 5 mols ethylene oxide and 4 mols propylene oxide, fatty acid partial glycerides and/or water-miscible solvent, such as for example propylene glycol or glycerol. The amount of additional dispersion aids used in the textile treatment compositions of the invention normally may range from about 0.5 to 70% by weight, based on the treatment composition.

The present invention also relates to a process for producing the textile treatment composition. The process of the invention involves thoroughly mixing the fatty acid condensation product with the dispersion accelerator and other optional dispersion aids and converting the resulting mixture into a powder form or into a shaped form, preferably flakes. An intimate mixture of fatty acid condensation product and dispersion accelerator can be obtained in particular by mixing molten fatty acid condensation product with a dispersion accelerator and the other constituents, if any, allowing the resulting mixture to cool and then further processing the cooled and solidified mixture into powder or shaped form.

In one preferred embodiment of the present invention, a fatty acid condensation product having a degree of reaction of at least about 95% and preferably at least about 99% is mixed as a melt, at a temperature of 80° to 150° C. with a dispersion accelerator and with other additives, if any. The molten mixture then is neutralized with a low molecular weight organic carboxylic acid or hydroxycarboxylic acid and the neutralized fatty acid condensation product-dispersion accelerator melt is processed further into powder or into a shaped form such as flakes.

The textile treatment compositions of the present invention readily may be made into stable dispersions in water, even cold water, simply by mixing the composition with water and then stirring gently. The dispersions obtained are extremely stable and show substantially no tendency to separate. The dispersions of the textile treatment compositions can be used in various ways for treating fibers, yarns or fabrics. The treatment of fibers or yarns is carried out by standard textile methods, such as drawing, immersion-spinning, padding or spraying.

Using the textile treatment compositions of the present invention in detergents improves detergency and/or provides a softening of the laundered fabrics. Compositions of the present invention, thus also are paticularly suitable for preparing aqueous fabric softener concentrates which have an active-component concentration of from about 10 to around 50% by weight (instead of the usual, lower concentration of around 5% by weight). The textile treatment compositions of the present invention also may be used as constituents of post-treatment preparations for laundered fabrics for rendering the fabrics soft and antistatic. Post-treatment of laundered fabrics normally may be carried out during the final rinse or even during drying for example in an automatic dryer. To use the composition during the drying cycle, the laundry either is sprayed with a dispersion of the composition or the composition is applied to a substrate, for example a flexible sheet-form textile material and is used in that form.

In formulating such preparations, the composition of the present invention will be blended with other substances conventionally used in such applications. Such substances include, for example, optical brighteners, perfumes, dyes, bleaching agents, and the like. These optional ingredients are well-known to those skilled in the art.

Products of the present invention will differ in their composition depending on their intended use, i.e., according to the nature of the textile treatment. In other words, fatty acid condensation products having fatty acid residues of different chain lengths will be desired depending upon their intended application for the composition. For example, products of the present invention which have proved particularly effective for treating fibers and yarns and for the post-treatment of washed fabrics are those which contain an average of from 0.7 to 1 fatty acid residue, preferably a saturated fatty acid residue which contains essentially from 16 to 22 carbon atoms, to each polyamine functional group, i.e., per each amino or hydroxyl groups. For use in detergents, it is preferred to select those compositions which contain fatty acid condensation products of relatively short fatty acid residues, i.e., fatty acid residues essentially having from 12 to 16 carbon atoms, and on average from 0.3 to 1 and preferably from 0.3 to 0.5 fatty acid residues per polyamine functional group.

The following Examples are intended to illustrate the present invention without in any way limiting its scope, which is defined in the appended claims.

EXAMPLES

EXAMPLE 1

A known fatty acid condensation product suitable for the refinement of textiles was prepared by heating to a temperature of 200° C. under a nitrogen atmosphere and for 2.5 hours in a three-necked flask equipped with a stirrer, thermometer, nitrogen inlet pipe and dephlegmator, 405 g (1.5 mols) technical grade stearic acid and 104 g (1 mol) aminoethylethanolamine. Water was evolved during the reaction. The reaction was continued until about 99% of the stearic acid had been consumed. The acid number of the reaction product was determined by titration with potassium hydroxide (similar to determination of the acid number in fats and oils). Upon achieving an acid number of 1.5, the reaction mixture was cooled to 90° C. and free amino groups in the reaction product were neutralized by treatment thereof with glacial acetic acid. The homogeneous melt was converted into yellow, non-tacky flakes having a melting point of around 63° C.

EXAMPLE 2

The procedure of Example 1 was repeated, except that prior to flake formation 5% by weight sorbitol was added to the neutralized melt.

EXAMPLE 3

In a fine-steel, stirrer-equipped reaction vessel, 746.5 kg technical grade stearic acid (2816 mols) were melted under a nitrogen atmosphere at a temperature of 80° C. First, 192.1 kg aminoethyl ethanolamine (1847 mols) and 1 kg of 50% hypophosphorous acid as an anti-oxidant were successivey stirred into the melt. The mixture then was heated to 150° C. and distillate formation began. The vessel's contents were heated for 2.5 hours to 200° C. and then were stirred for 1 hour at 200° C. Over this time period a total of 50 kg of distillate accumulated. At this point, the acid number of the reaction mixture was determined to be below 5. After cooling to 100° C., the contents of the reaction vessel were mixed first with 48.0 kg of sorbitol and then with 62.9 kg of concentrated acetic acid. When the mixture appeared homogenous, the melt was converted into flake form using a flake-forming roller. Light yellow flakes were obtained.

EXAMPLE 4

In a fine-steel, stirrer-equipped reaction vessel, 420 kg technical grade stearic acid (1584 mols) were melted under a nitrogen atmosphere at a temperature of 80° C. First, 108 kg aminoethyl ethanolamine (1038 mols) and then 0.5 kg of 50% hypophosphorous acid as an anti-oxidant were mixed with the molten stearic acid. After heating the mixture to 150° C., water began to evolve from the molten mixture. The reaction mixture was heated to 200° C. over a period of 2.5 hours and then was stirred at that temperature for 1 additional hour. Over this time period, 28 kg of distillate accumulated. At this point, the acid number of the reaction mixture was determined to be below 2. After cooling the reaction mixture to 125° C., 50 kg of an adduct of a $C_{12}$–$C_{14}$ fatty alcohol and 5 mols ethylene oxide and 4 mols propylene oxide; 50 kg of sorbitol and 366 kg of an adduct of tallow alcohol and 40 mols ethylene oxide were successively stirred into the reaction mixture. After stirring for 15 hours, the melt appeared homogenous. The melt then was cooled to 100° C., and 34 kg of concentrated acetic acid were mixed with the melt and the mixture was formed into light yellow flakes using a flake-forming roller.

EXAMPLE 5

2.5 g samples of the flaked material of Examples 1 and 2 were stirred into a glass beaker containing 500 ml of deionized water at a temperature of 20° C., (flat-blade stirrer, 150 r.p.m.). The time required to obtain a complete dispersion was 90 minutes for the material of Example 1 and only 15 minutes for the material of Example 2 comprising a composition of the present invention. In a similar fashion, the products of Examples 3 and 4 were dispersed fully in water in less than 15 minutes.

EXAMPLE 6

10 g of the product of Example 4 was covered with 90 g water in a glass beaker and left standing. After 6 hours, the contents of the beaker were gently stirred. A homogeneous, stable disperson was formed in which no individual particles could be detected with the naked eye. Upon filtering the dispersion through a fine-mesh (approx. 0.1 mm) black polyester cloth, no visible residue remained.

EXAMPLE 7

Cotton terry cloth was treated by absorption for 20 minutes with a textile treatment solution containing, per liter of water, 30 g of a 10% stock solution prepared by sprinkling the product of Example 2 into cold water and stirring for 30 minutes at room temperature (solution temperature 45° C., solution ratio 1:20). The cloth then was dried for 3 minutes at 120° C. Cotton-polyester cloth was treated similarly by padding with a solution which, in addition to standard textile-refining agents, contained, per liter of water, 60 g of 10% stock solution of the product of Example 4 (prepared as described above). The cloth then was dried similarly. In both cases, fabrics were obtained which were not discolored and which had a pleasant soft feel.

EXAMPLE 8

Mannitol in an amount of 5% by weight was added as a dispersion accelerator to the neutralized melt of the fatty acid condensation product of Example 1. The textile treatment composition thus obtained exhibited the propeties described in Examples 6 and 7 for the products of Examples 2 and 4. When an equal amount of glucose or gelatin was added as the dispersion accelerator to the Example 1 condensation product, similar results were obtained.

EXAMPLE 9

When 10% by weight sorbitol, mannitol, glucose or gelatin was added to the Example 1 condensation product, a time period of less than 15 minutes was required to obtain a complete dispersion of the textile treatment composition in the test described in Example 5.

EXAMPLE 10

Fatty acid condensation products which were prepared in accordance with Example 1 using stearic acid and an equi-molar mixture of diethylene triamine and triethylene tetramine and which thereafter were converted into a readily dispersible form by addition of a dispersion accelerator in accordance with Examples 2, 8 and 9 had properties comparable to those described in Examples 5, 6 and 7.

EXAMPLE 11

A fatty acid condensation product was prepared in accordance with Example 3 from hydrogenated tallow and aminoethyl ethanolamine in equimolar quantities. Textile treatment compositions were obtained using 5% and 10% by weight additions of sorbitol, mannitol, glucose, or gelatin and with 1:1-mixtures of gelatin with sorbitol, with mannitol or with glucose which behaved very similarly to the above-described textile treatment compositions of the present invention.

EXAMPLE 12

A fatty acid condensation product was prepared in accordance with Example 3 from coconut oil and aminoethyl ethanolamine (molar ratio 0.5:1). The addition of 5% and 10% by weight sorbitol, mannitol, glucose or gelatin and 1:1-mixtures of gelatin with sorbitol, with mannitol or with glucose to the fatty acid condensation product gave textile treatment compositions which were comparable in their rate of dispersion with the previously described textile treatment compositions of the present invention.

EXAMPLE 13

A composition according to the present invention was prepared by adding 5% by weight gelatin to the fatty acid condensation product of Example 11. Then, a textile treatment solution was prepared from the textile treatment composition in accordance with Example 7 and was used to treat cotton terry cloth textiles for 7 minutes at room temperature. Non-discolored fabrics having a pleasant soft feel were obtained after drying.

EXAMPLE 14

3.0% by weight of a textile treatment composition of the present invention was added to a standard detergent (IEC test detergent containing perborate, type 1 in the formulation of May, 1976) having the following composition:

6.4% by weight Na-alkylbenzene sulfonate
2.3% by weight of an adduct of tallow alcohol and 14 mols ethylene oxide
2.8% by weight soap
35.0% by weight Na-triphosphate
6.0% by weight Na-silicate
1.5% by weight Mg-silicate
1.0% by weight carboxymethyl cellulose
0.2% by weight Na-EDTA
0.2% by weight optical brightener
20.0% by weight Na-perborate
16.8% by weight Na-sulfate
7.8% by weight water The textile treatment composition was prepared by reacting coconut oil fatty acid (at least 50% $C_{12}$–$C_{14}$-fatty acids) with N,N-dimethylaminopropylamine (molar ratio of fatty acid to polyamine of 1:1) in the presence of 5% by weight sorbitol. Cotton fabrics artificially soiled with make-up (cosmetic) cream, mascara and lipstick were washed with this detergent together with ballast laundry. For purpose of comparison, similarly soiled fabrics were washed with a detergent that did not contain the textile treatment composition of the present invention. The test fabrics washed with the detergent containing the textile treatment composition of the present invention were distinctly cleaner than the test fabrics washed with the detergent which did not contain the textile treatment composition of the present invention.

EXAMPLE 15

This Example describes the composition of a post-treatment preparation for laundry. The preparation includes 3.5% by weight dimethyldihydrotallowalkyl ammonium chloride
2.5% by weight of the product of Example 4
0.5% by weight of an adduct of stearyl alcohol and approx. 12 mols ethylene oxide
0.05% by weight optical brightener for cotton
0.07% by weight perfume
0.0015% by weight dye
1.25% by weight isopropyl alcohol
0.5% by weight of a preservative and the remainder water To prepare this detergent, the solid ingredients were mixed as a melt at a temperature of 80° C. and the melt was stirred thereafter into water at 80° C. After the dispersion which formed had cooled, the perfume was added.

The post-treatment preparation was applied to fabrics by treating them with a solution containing 3 g of the post-treatment preparation per liter of water. After drying, the fabrics had a pleasant fragrance and a full soft feel.

Although certain embodiments of the present invention have been described in detail, it will be appreciated that other embodiments are contemplated along with modification of the disclosed features, as being within the scope of the invention, which is defined in the appended claims.

We claim:

1. A textile treatment composition for use in refining fibers and yarns or in preparations for post-treatment of laundered fabrics, consisting essentially of:

(A) at least one dispersion accelerator present in about 0.5–10% by weight based upon the combined weight of the dispersion accelerator and fatty acid compositon, which is: a natural or synthetic hydrophilic polymer or a mixture thereof;

(B) a fatty acid condensation product obtained by reacting an aliphatic monocarboxylic acid or amide-forming derivative thereof having from 8 to 22 carbon atoms with a polyamine and neutralizing resulting unreacted amino groups, said amide-forming derivative being a lower alkanol fatty acid ester, fatty acid glyceride, or fatty acid halide; and (C) at least one secondary dispersion aid which may be present in 0 to about 70% by weight, based on the weight of the treatment composition.

2. The textile treatment composition of claim 1 wherein said polyamine corresponds to the formula $$H_2N\left[(CH_2)_n-\underset{\underset{R}{|}}{N}\right]_m R'$$

wherein

R is hydrogen, methyl, ethyl or hydroxyethyl,

R′ is hydrogen, methyl, ethyl, hydroxyethyl or $-(CH_2)_n-NHR$, n is 2 to 4, and m is 1 to 4.

3. The textile treatment composition of claim 1 wherein about 2 to about 10% by weight of said dispersion accelerator is present, based on the combined weight of the dispersion accelerator and the fatty acid condensation product.

4. The textile treatment composition of claim 1 wherein said dispersion accelerator comprises at least a monosaccharide and/or a hydrogenation product thereof.

5. The textile treatment composition of claim 2 wherein said dispersion accelerator comprises at least a monosaccharide and/or a hydrogenation product thereof.

6. The textile treatment composition of claim 1 wherein said dispersion accelerator is at least one of glucose, sorbitol, mannitol or gelatin.

7. The textile treatment composition of claim 2 wherein said dispersion accelerator is at least one of glucose, sorbitol, mannitol or gelatin.

8. The textile treatment composition of claim 6 wherein about 5 to 10% by weight of said dispersion accelerator is present based on the combined weight of the dispersion accelerator and the fatty acid condensation product.

9. The textile treatment composition of claim 7 wherein about 5 to 10% by weight of said dispersion accelerator is present based on the combined weight of the dispersion accelerator and the fatty acid condensation product.

10. The textile treatment composition of claim 1 wherein said dispersion accelerator is gelatin.

11. The textile treatment composition of claim 10 wherein about 5 to 10% by weight of said dispersion accelerator is present.

12. The textile treatment composition of claim 1 wherein said dispersion accelerator is a mixture of monosaccharides and/or hydrogenation products thereof with gelatin.

13. The textile treatment composition of claim 1 further comprising at least one secondary dispersion aid present in an amount of about 0.5 to 70% by weight, based upon the weight of the treatment composition, selected from the group consisting of fatty alcohol ethoxylates, oxoalcohol alkoxylates and mixtures thereof.

14. The textile treatment composition of claim 1 wherein said dispersion accelerator is at least one of: fructose, sorbose, glucose, sorbitol, mannitol, gelatin, guar, dextrin, xanthan, tragacanth, gum arabic, agar agar, carrageen, casein or; homopolymers or copolymers of polyvinyl alcohol, polyacrylic acid and/or polyvinyl pyrrolidone.

15. The textile treatment composition of claim 1 wherein (A) said at least one dispersion accelerator is glucose, sorbitol, mannitol, gelatin, or any mixture thereof; and (B) said at least one fatty acid condensation product is the condensation product of stearic acid and aminoethylethanolamine whose free amino groups are neutralized with acetic acid.

16. The textile treatment composition of claim 15 wherein prior to neutralization of said amino groups: a secondary dispersion aid which is an adduct of a $C_{12}$–$C_{14}$ fatty alcohol, 5 mols of ethylene oxide, and 4 mols of propylene oxide; and an adduct of tallow alcohol and 50 mols of ethylene oxide; together present in an amount of about 0.5 to 70% by weight, based upon the weight of the treatment composition, are mixed with said condensation product.

17. A method for refining textiles, which comprises contacting said textiles with the textile treatment composition of claim 1.

18. A method for refining textiles, which comprises contacting said textiles with the textile treatment composition of claim 15.

19. A method for refining textiles, which comprises contacting said textiles with the textile treatment composition of claim 16.

20. A method for washing textiles which comprises adding the textile treatment composition of claim 1 to said textiles undergoing washing.

21. A method for washing textiles which comprises adding the textile treatment composition of claim 15 to said textiles undergoing washing.

22. A method for washing textiles which comprises adding the textile treatment composition of claim 16 to said textiles undergoing washing.

23. A method of post-treating laundered textiles which comprises contacting said textiles with the textile treatment composition of claim 1.

24. A method for post-treating laundered textiles which comprises contacting said textiles with the textile treatment composition of claim 15.

25. A method for post-treating laundered textiles which comprises contacting said textiles with the textile treatment composition of claim 16.

26. The textile treatment composition of claim 1 wherein said natural or synthetic hydrophilic polymer is: an aldose- or ketose-type monosaccharide, or a polyhydroxyl compound obtained from said monosaccharide by hydrogenation.

* * * * *